US007068793B2

(12) United States Patent
Shim

(10) Patent No.: US 7,068,793 B2
(45) Date of Patent: Jun. 27, 2006

(54) METHOD OF AUTOMATICALLY FITTING HEARING AID

(76) Inventor: Yoon Joo Shim, 151-85, Yeonhui-dong, Seodaemun-ku, Seoul 120-110 (KR)

( * ) Notice: Subject to any disclaimer, the term of this patent is extended or adjusted under 35 U.S.C. 154(b) by 588 days.

(21) Appl. No.: 10/416,097

(22) PCT Filed: Nov. 2, 2001

(86) PCT No.: PCT/KR01/01857

§ 371 (c)(1),
(2), (4) Date: May 2, 2003

(87) PCT Pub. No.: WO02/39784

PCT Pub. Date: May 16, 2002

(65) Prior Publication Data

US 2004/0028250 A1 Feb. 12, 2004

(30) Foreign Application Priority Data

Nov. 2, 2000 (KR) ..... 2000-0064966

(51) Int. Cl.
*H04R 25/00* (2006.01)

(52) U.S. Cl. ..... 381/60; 381/314

(58) Field of Classification Search ..... 381/60
See application file for complete search history.

(56) References Cited

U.S. PATENT DOCUMENTS 4,953,112 A * 8/1990 Widin et al. ..... 600/559
5,386,475 A * 1/1995 Birck et al. ..... 381/60

FOREIGN PATENT DOCUMENTS

WO WO 9009760 A1 * 9/1990

* cited by examiner

*Primary Examiner*—Sinh Tran
*Assistant Examiner*—Daniel Swerdlow
(74) *Attorney, Agent, or Firm*—Ober/kaler

(57) ABSTRACT

Provided is a method of automatically fitting a hearing aid. The method includes the steps of entering an audiogram of a test subject, defining criterion gains and SSPLs according to the test subject's audiogram in each test frequency band, generating 70dB SPL long term speech spectrum noise, and measuring the gains and SSPLs of the amplified sound in front of test subject's eardrum using the probe tube microphone, comparing the measured gains and SSPLs with the criterion gains and SSPLs and if the measured gains and SSPLs are less than the criterion gains and SSPLs, increasing the gain and SSPL of the hearing aid and repeating measurement, and if the measured gains and SSPLs becomes equal to the criterion gains and SSPLs, setting the gains and SSPLs of the hearing aid at that time as an actual gain and/or SSPL of the hearing aid and saving the automatic fitting device.

2 Claims, 3 Drawing Sheets

METHOD OF AUTOMATICALLY FITTING HEARING AID

TECHNICAL FIELD

The present invention relates to a method of adjusting the gain, i.e. the amount of amplification and the saturated sound pressure level (SSPL), i.e. the maximum output limit of amplification of a hearing aid (to be referred to as 'hearing aid fitting'), and more specifically, to a method of automatically fitting a hearing aid in a state in which the hearing aid is worn in the ear of a user.

BACKGROUND ART

In general, the human ear is divided into three primary parts: outer ear, middle to ear and inner ear. The sound vibration occurring outside the ear is directed into an earcanal of the outer ear by pinna, travels along the earcanal and arrives at the tympanic membrane (eardrum). The earcanal is a kind of a resonance tube the end of which is closed by the eardrum. The vibration of the eardrum is transmitted to the inner ear through three small bones in the middle ear, namely, malleus, incus, and stapes. When the vibrations of the ossicles are transmitted to cochlea through the footplate of the stapes, endolymph inside the cochlea moves, and thousands of tiny hair cells in the scala media in the cochlea moves as well accordingly, the result of which is then conversion of the acoustic stimuli into electrical signals. Then the electrical signals are transmitted to the brain through the central nervous system, and sound perception occurs. Hearing loss, which requires wearing of a hearing aid, is classified into three types: conductive hearing loss, sensorineural hearing loss and mixed hearing loss. Although all the three types could be alleviated with hearing aids, persons with sensorineural hearing losses are the usual candidates for hearing aids. Persons with conductive hearing loss are usually treated with medicine or surgery. And those with mixed losses are medically and surgically treated first and then hearing aids are recommended.

Hearing aids are classified into three major types: pocket type, behind-the ear (BTE) type and in-the-ear (ITE) type. The ITE type is subdivided further according to the depths of insertion and sizes. Recently, the ITE types are the preferred ones due to its less conspicuous appearance and to less cumbersome aspect. In order to prevent from further worsening of hearing loss through over-amplification and to assure clearer speech perception ability, hearing aids should be fitted optimally individually. Here, the phrase 'hearing aid fitting' is used to mean a process of selecting an appropriate hearing aid according to the audiogram of hearing impaired person, periodically checking the hearing aid performances such that the gain and SSPL of each frequency band of the hearing aid are accurately tuned, thereby monitoring the hearing aid performance so as to be used without malfunction.

However, all the conventional hearing aid fitting methods, either utilize criteria of indirectly standardized values of a so-called insertion gain or 2 cc coupler gain, or adjust according to wearer's subjective judgment, as shown in FIG. 1. The insertion gain is the average difference between unaided and aided gain, and the 2 cc coupler gain is the average gain standardized to normal earcanal volumes of Caucasian adults without wearing earmolds connected to hearing aids. That is, the adjustments of the gains and SSPLs of hearing aids are not made to the amplified sounds in front of tympanic membranes with hearing aids on, so that various variables concerning different earmolds, different sizes of earcanals, location of hearing aid microphone and so on affect differently in each individual, the result of which is that the criteria might be meaningless in most patients. Referring to FIG. 1, for example, according to the conventional hearing aid fitting method, patient's identification (ID) and audiogram are entered, a couple of hearing aid conditions, i.e., the type of earmold and the type of hearing aid are selected and then a 'best fit' button is pushed (steps S101 through S104). When the 'best fit' is activated, criterion values for gains and SSPLs obtained by the 2 cc coupler average values are determined in each frequency band irrespective of the various states and conditions of individuals. The patient then wears hearing aids on and signals of the amplitudes of 50 dB SPL (for gain) are swept throughout the whole frequency range, and the wearer reports whether stimuli of each frequency band are equally loud or not. If not, the discrepant portions are corrected (steps S105 through S107). And then, stimuli of 90 dB SPL (for SSPL) are swept and the same subjective corrections are made.

Since conventional hearing aid fitting methods adopt average criterion values based on 2 cc coupler measurements or insertion gain, which are not standardized on individually measured output values of hearing aid in front of the eardrum, individual variables of size of external earcanal, shape of earmolds, location of the microphone of hearing aid, the state of pinna and the like are not taken into consideration, so that it is impossible to achieve accurate individual fitting so as to be tailored to the individual user. Also, the sweeping procedure not only requires a longer fitting time, but also is an inaccurate method, since subjective judgment is inaccurate frequently. Therefore, several revisits for readjustment are a routine procedure. Furthermore, since the user's subjective cooperation is required in fitting procedure, conventional procedures are incapable methods to apply in cases of infants or elderly persons.

DISCLOSURE OF THE INVENTION

The goal of the present invention is to provide a method of automatically fitting hearing aids, by detecting and controlling the amplified sounds from hearing aids in front of a tympanic membrane, using a probe tube microphone being inserted in front of eardrum, while delivering a long term speech spectrum noise, i.e. the average spectrum of noise of speech sounds of 70 dB sound pressure level (SPL) in front of hearing aid, in a state in which the hearing aid is worn by a test subject.

To accomplish the above object, first, the fitting criteria for gain and SSPL according to the degrees of hearing losses at each frequency band are installed in a fitting system ahead of time, which are standardized in real ear, that is, in front of the tympanic membrane with hearing aids on. To obtain the above criteria, the gains and SSPLs of optimal levels had been measured from more than 5 hundred hearing impaired persons at 250, 500, 750, 1000, 1500, 2000, 3000, 4000 and 6000 Hz in real ear measurement, that is, while the probe tube microphone being inserted in front of tympanic membrane, with a hearing aid on, and delivering a long term speech spectrum noise of 70 dB SPL in front of the hearing aid, which is an average amplitude of speech spectrum noise at all the frequency ranges of speech as mentioned above.

The fitting procedure of present invention is as follows. The patient's ID and the audiogram are entered in the fitting system, which results in the decisions of the criterion gain and SSPL values for each frequency band for that person. Then the probe tube microphone is inserted into the earcanal and hearing aid is worn. The fitting system, generating the 70 dB SPL long term speech spectrum noise in front of the hearing aid, measures the output gain and SSPL of the hearing aid through the probe tube microphone in front of eardrum, whether the gain of 1 is the same as the gain criterion for that patient at 250 Hz. If it is, the SSPL of 90 is evaluated in the same manner that if it is the same as the SSPL criterion for that patient at 250 Hz. If the gain criterion is greater than 1, the gain of 2 is compared with the gain criterion, increasing consecutively until it becomes the same as the gain criterion of 250 Hz. When it arrives at the gain criterion of 250 Hz, the obtained gain of the hearing aid is saved to the hearing aid and to the fitting system, and the SSPL is started to compare. The same method is applied to achieve the SSPL at 250 Hz. If both the gain and SSPL of 250 Hz are saved, 500 Hz are adjusted, applying the same method as 250 Hz. All the remaining frequencies such as 750, 1000, through 6000 Hz are adjusted consecutively in the same manner.

BEST MODE FOR CARRYING OUT THE INVENTION

A preferred embodiment of the present invention will now be described with reference to the accompanying drawings.

Figure 1:
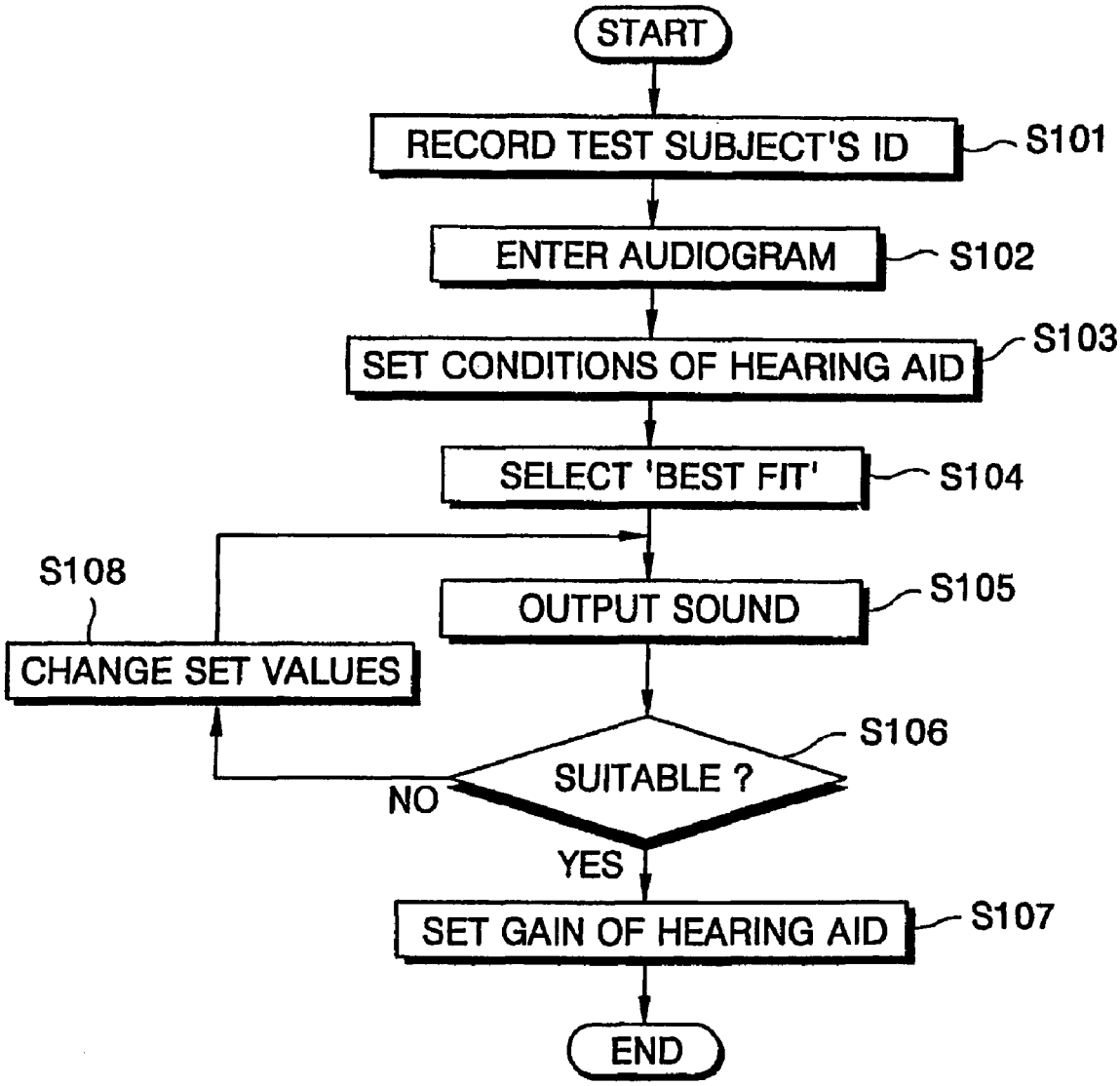
FIG. 1 is a flow chart showing a conventional method of fitting a hearing aid.
Figure 2:
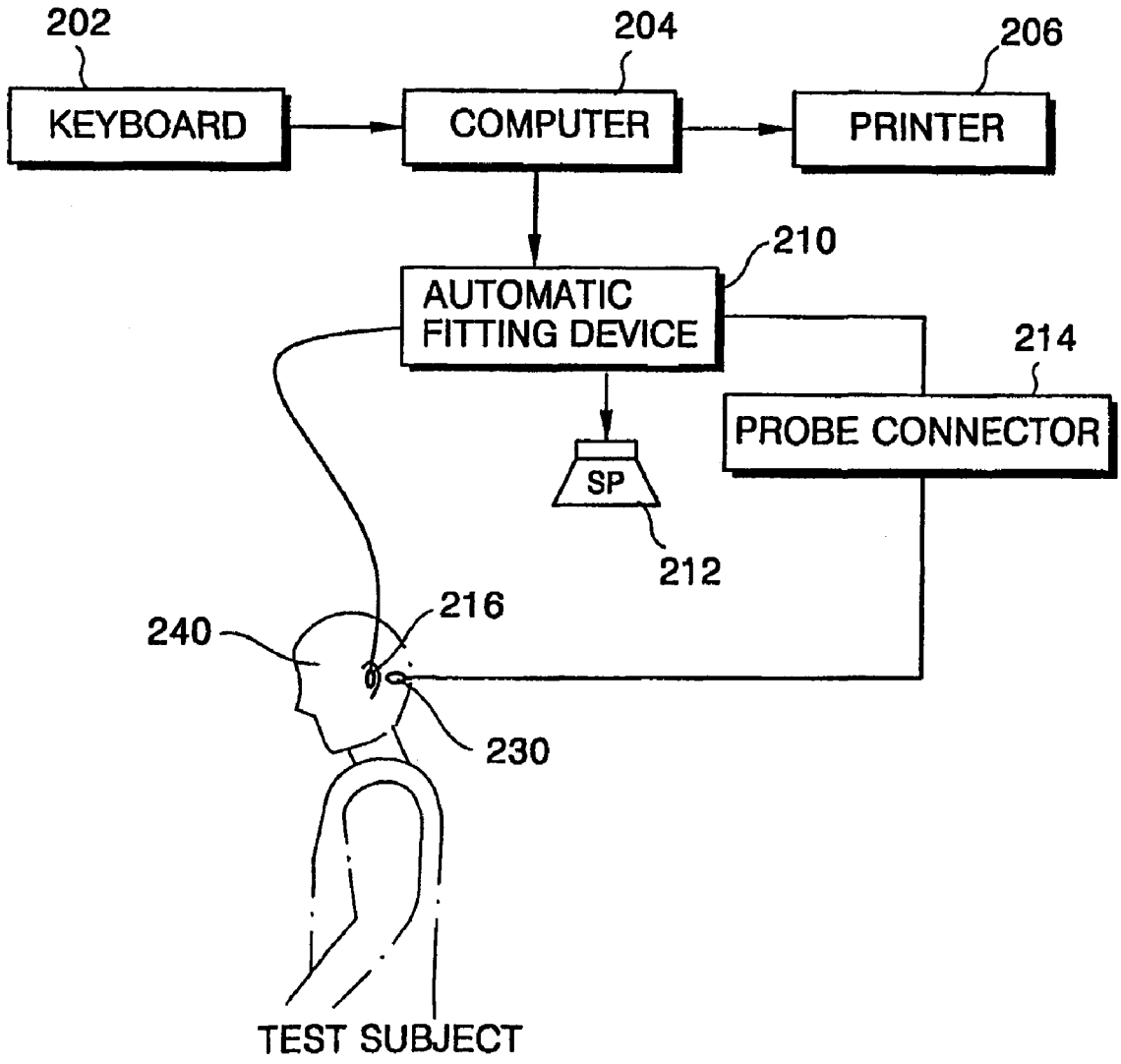
FIG. 2 is a schematic diagram of a system of automatically fitting a hearing aid according to the present invention.

FIG. 2 is a schematic diagram of an automatic hearing aid fitting system according to the present invention. The automatic hearing aid fitting system includes a key board 202, a computer 204, a printer 206, an automatic fitting device 210, a speaker 212, a probe connector 214 connected to a hearing aid 230 and to the automatic fitting device 210, a probe tube microphone 216 connected to the automatic fitting device 210, and the hearing aid 230 connected to the probe connector 214. The computer 204 has an operating system (O/S) and fitting-related program loaded therein. In response to an operator's manipulation of the key board 202, the computer 204 controls the automatic fitting device 210 and manages various kinds of data. Also, the computer 204 monitors the operation state to exhibit the monitored data to the operator and allows the results to be printed by the printer 206.

The automatic fitting device 210 monitors the amplified sound transmitted to the tympanic membrane, which is the results of all the parameters taken into account, measures the same, and performs the overall fitting procedure in accordance of computer's control. The automatic fitting device 210 is designed such that gain and saturated sound pressure level (SSPL) are varied at frequencies of 250, 500, 750, 1000, 1500, 2000, 3000, 4000 and 6000 Hz, thereby setting the gain and SSPL of the hearing aid through the probe connector 214. Although the automatic fitting device 210 preferably employs a PFS6000 model, which is a Starkey hearing aid fitting system, it can be applied to any kinds of digital hearing aid fitting systems.

According to the present invention, since the optimal criteria for gains and SSPLs were obtained in real ear measurement according to the degrees of hearing loss at each frequency band, and the automatic fitting device 210 monitors at the same place (in front of eardrum) so that the exact criteria are used in automatic fitting as standardized, the test subject, i.e. the testee 240 is not required to respond subjectively to the sound, which is not only convenient to the test subject 240, but also exact fitting is achieved in a few second.

Figure 3:
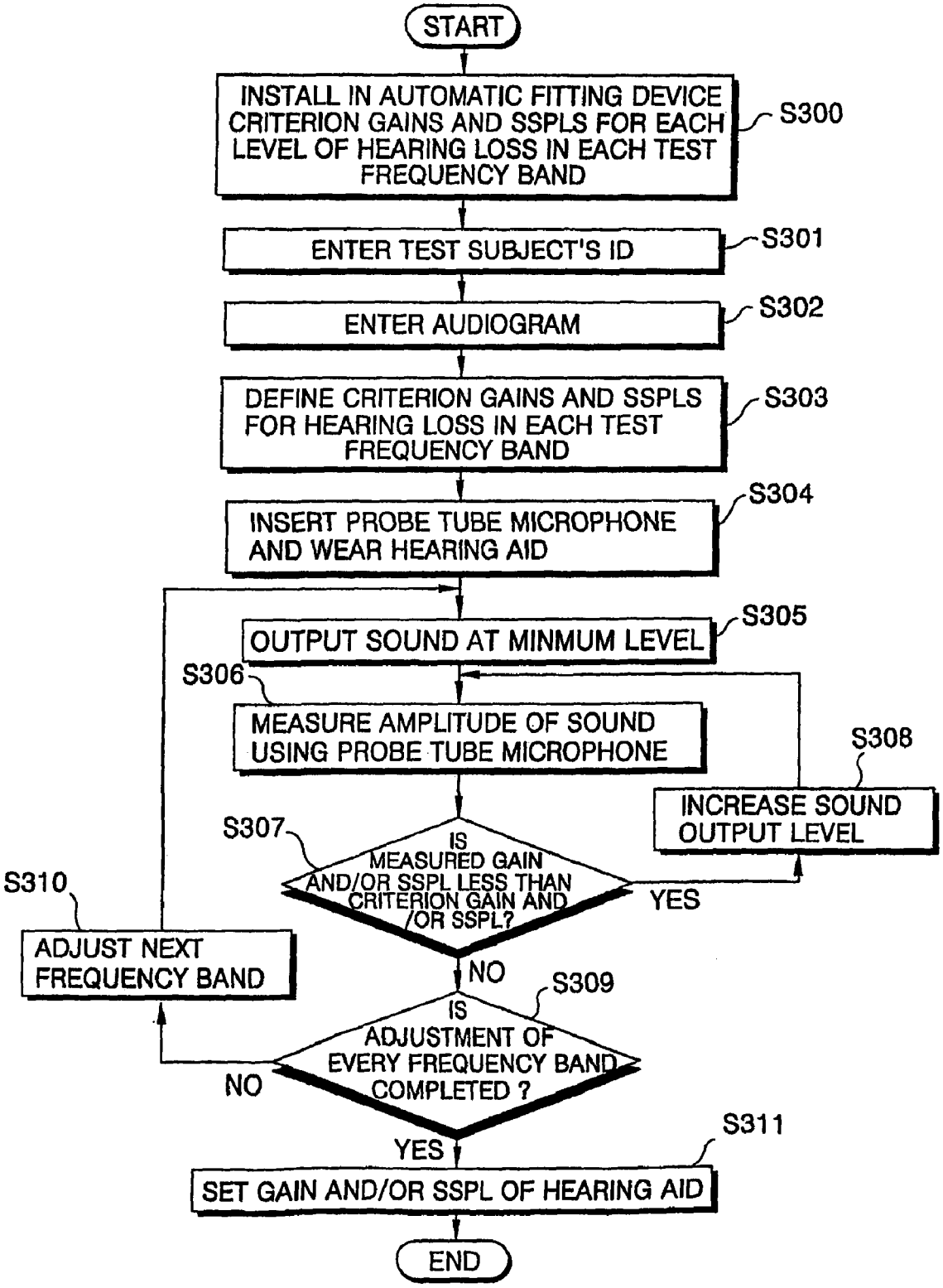
FIG. 3 is a flow chart showing a method of automatically fitting a hearing aid according to the present invention.

FIG. 3 is a flow chart showing a method of automatically fitting a hearing aid according to the present invention.

First, the test subject's hearing loss has to be measured using a pure tone audiometer. The audiometer allows the test subject to hear test signals of pure tones of 250, 500, 750, 1000, 1500, 2000, 3000, 4000, and 6000 Hz. These signals are transmitted to either a receiver to obtain air conduction thresholds of the above frequencies or to a bone vibrator to obtain bone conduction thresholds of the same frequencies. The intensity of the signals is controlled by a hearing loss dial. The air conduction threshold test is a technique of measuring the test subject's entire level of hearing loss. The bone conduction threshold test is a technique of measuring the levels of hearing loss in the cochlea and central nervous system. In fact, the air conduction thresholds are the only ones required for fitting a hearing aid. The air conduction thresholds are measured by adjusting the scale of the hearing loss dial while the test earphones are worn over the testee's ears. The minimum intensity detected by the testee is the threshold for that test frequency. The bone conduction thresholds are obtained with the bone vibrator being attached to a mastoid process behind the ear. The measurement is made in the same manner as in the air conduction threshold test. The thresholds for normal ears range around 0–20 dB HL. However, in the case of hearing loss, the signals must be increased louder than those for normal ear before they can be heard, so that the thresholds in cases of hearing loss are values greater than those for normal ear. The reference value is called hearing level (HL). The thresholds for air and bone conduction are measured for each frequency, e.g., 250, 500, 750, 1000, 1500, 2000, 3000, 4000 and 6000 Hz, using an audiometer, and the values are plotted on an audiogram.

Now, referring to FIG. 3, in step S300, the fitting criteria for gain and SSPL according to the degrees of hearing losses at each frequency band are installed in the automatic fitting device 210 ahead of time, which are standardized in real ear, that is, in front of the tympanic membrane with hearing aids on. To obtain the above criteria, the gains and SSPLs of optimal levels had been measured from more than 5 hundred hearing impaired persons at 250, 500, 750, 1000, 1500, 2000, 3000, 4000 and 6000 Hz in real ear measurement, that is, while the probe tube microphone 216 being inserted in front of tympanic membrane, with a hearing aid on, and delivering a long term speech spectrum noise of 70 dB SPL in front of the hearing aid, which is an average amplitude of speech spectrum noise at all the frequency ranges of speech as mentioned above.

In steps S301 and S302, in order to control data for each test subject, the test subject's ID is entered, and the audiogram obtained as described above is entered as well. When the air conduction thresholds of the obtained audiogram are entered, the criterion values for gain and SSPL for each frequency for the specific level of hearing loss is automatically defined based on a predetermined standard prepared by the present inventor as mentioned above (step S303).

Then, in step S304, the test subject wears the hearing aid in a state in which a probe tube microphone is inserted into his earcanal. Since the amplified sounds of the hearing aid worn by the testee are measured directly by the probe tube microphone 216 in front of the tympanic membrane in each test frequency band, and the criterion gain and SSPL values were those of being standardized in real ear measurement, which are used just in the same way at this adjusting procedure, the adjusted gains and SSPLs of the hearing aid cannot but be accurate.

Subsequently, in steps S305 to S311, the automatic fitting device 210 starts fitting from a lower frequency band. First, starting at 250 Hz, in the case that the gain of the hearing aid is 1, i.e. the minimum level, the gain of the amplified sound from the hearing aid measured in front of the eardrum is compared with the defined criterion gain value at 250 Hz. If it corresponds, the gain 1 is saved to the hearing aid and to the computer. And then, SSPL of 250 Hz is adjusted. If the gain of the amplified sound from the hearing aid is less than the criterion gain value, the gain of the hearing aid is increased to 2 and at that time the gain of the amplified sound from the hearing aid is compared with the defined criterion gain value at 250 Hz, and so forth, until the obtained gain reaches the defined criterion gain value. As soon as the obtained gain corresponds the criterion gain value, the gain of the hearing aid is being stopped increasing and the gain of the hearing aid at that time is saved to the hearing aid and to the computer so as to be set as an actual gain, and then the SSPL of 250 Hz is being adjusted. First, the SSPL of 90 (the minimum level) of the hearing aid output is compared with the SSPL criterion value for 250 Hz. That is, in the case that the SSPL of the hearing aid is 90, the SSPL of the amplified sound from the hearing aid measured in front of the eardrum is the same as the defined SSPL criterion value, the SSPL 90 is saved to the hearing aid and to the computer. If the SSPL of the amplified sound from the hearing aid is less than the defined SSPL criterion value of 250 Hz, the SSPL of the hearing aid is increased to 91 and at that time the SSPL of the amplified sound from the hearing aid is compared with the criterion SSPL value of 250 Hz, and so forth, until the obtained SSPL reaches the defined SSPL criterion value. As soon as the obtained SSPL corresponds the criterion SSPL value, the SSPL of the hearing aid is being stopped increasing and the SSPL of the hearing aid at that time is saved to the hearing aid and to the computer so as to be set as an actual SSPL. Immediately then the gain and SSPL of 500 Hz are adjusted. The adjustments of gains and SSPLs are made in each consecutive frequency up to 6000 Hz. That is, the steps S305 through S309 are repeatedly performed. In other words, gains and SSPLs of each frequency band of the hearing aid are adjusted automatically by monitoring the output sound of the hearing aid directly in front of tympanic membrane, using the criterion gains and SSPLs which are standardized directly in front of tympanic membrane, through the probe tube microphone 216 inserted into the test subject's ear.

Here, the actual gain and SSPL at all frequency bands may be input to the hearing aid at once, or may be separately input whenever the actual gain and SSPL is adjusted in sequence for each frequency band.

The automatic hearing aid fitting method may be applied to a multi-channel digital hearing aid adjustable for each frequency band. In cases of multi-channel digital hearing aids adjustable for each frequency band, when the criterion values of gains and SSPLs are achieved consecutively in real time and real ear, they are consecutively and spontaneously saved to the hearing aid and to the automatic fitting device.

Industrial Applicability

The present invention has 4 aspects superior to conventional fitting methods: accuracy, speed, automatic fitting and only one kind of model being required to be manufactured. First of all, the present method is accurate and does not require a second visit of the patient, whereas it is a routine procedure for several revisits in conventional methods because of inaccurate fitting and dissatisfaction of patients. The present method is accurate because the gains and SSPLs that are standardized in front of tympanic membrane to the amplified output sounds of hearing aids worn by testees using a probe tube microphone will be installed in an automatic fitting device, thereby monitoring and adjusting the gains and SSPLs of the hearing aid in a state in which the same condition used in providing the standardization of test subject wearing a hearing aid, through a probe tube microphone in front of eardrum. On the other hand, conventional methods utilize indirectly standardized gains and SSPL of 2 cc coupler or insertion gain, or subjective appraisal of loudness comparison.

Secondly, the present invention automatically adjusts the gains and SSPLs in a few second, whereas conventional methods take several weeks for more satisfactory fitting.

Thirdly, since the present method automatically adjusts the gains and SSPLs and does not require subjective cooperation from patients, there is no limit in age range or the state of consciousness or intelligence in part of the user, whereas conventional methods need subjective cooperation, so that infants, elderly, and mentally retarded cannot participate in fitting.

Fourthly, when using the present method, only one model is required to be produced, so that not only in viewpoint of patient, but also of the manufacturer, of nation, and of world economics, the least expense is spent. Moreover, the present method does not require to hire expensive specialist, so that the price of a hearing aid can become further be reduced. Conventionally, a hearing aid dealer has to hire at least a couple of specialists for counseling and fitting, and most of patients own several hearing aids due to dissatisfaction in fitting.

What is claimed is:

1. A method of fitting a hearing aid, by amplifying a 70 dB SPL long term speech spectrum noise generated from an automatic fitting device in the hearing aid, and measuring gains and SSPLs of the amplified sound of the hearing aid by a probe tube microphone, in a state in which the hearing aid is worn by a test subject with the probe tube microphone inserted into the external ear canal, the method including the steps of:

(1) entering an audiogram of a test subject;

(2) defining criterion gains and SSPLs depending on the test subject's audiogram, based on the criterion gains and SSPLs installed in the automatic fitting device, the criterion gains and SSPLs being standardized in real ear measurement for each level of hearing loss in each test frequency band;

(3) generating the 70dB SPL long term speech spectrum noise, and monitoring and measuring the gains and/or SSPLs of the amplified sound from the hearing aid in front of the test subject's eardrum by means of the probe tube microphone, starting at 250Hz and consecutively fitting the upper next frequencies upto 6000 Hz, from a predetermined minimum gain and/or SSPL of the hearing aid;

(4) comparing the measured gains and/or SSPLs with the criterion gains and/or SSPLs and if the measured gains and/or SSPLs are less than the criterion gains and/or SSPLs, increasing the gain and/or SSPL of the hearing aid and repeating measurement; and (5) if the measured gains and/or SSPLs becomes equal to the criterion gains and/or SSPLs, setting the gains and/or SSPLs of the hearing aid at that time as an actual gain and/or SSPL of the hearing aid and saving the automatic fitting device.

2. The method according to claim 1, wherein in cases of multi-channel digital hearing aids adjustable for each frequency band, when the criterion values of gains and/or SSPLs are achieved consecutively in real time and real ear, they are consecutively and spontaneously saved to the hearing aid and to the automatic fitting device.

* * * * *